US005758908A

United States Patent [19]

Haasch

[11] Patent Number: 5,758,908

[45] Date of Patent: Jun. 2, 1998

[54] OIL COOLER WITH IMPROVED COOLANT HOSE CONNECTION

[75] Inventor: James T. Haasch, Bay View, Wis.

[73] Assignee: Modine Manufacturing Company, Racine, Wis.

[21] Appl. No.: 651,140

[22] Filed: May 22, 1996

[51] Int. Cl.[6] ..... F28F 1/04; F16L 13/02; F16L 41/08

[52] U.S. Cl. ..... 285/192; 285/284.1; 285/179.1; 285/148.22; 285/288.1; 165/177; 165/916; 29/890.034

[58] Field of Search ..... 165/177, 178, 165/167, 168, 916; 29/890.034; 281/192, 188, 148.22, 288.1, 179.1, 284.1

[56] References Cited

U.S. PATENT DOCUMENTS

| | | | |
|---|---|---|---|
| 2,360,123 | 10/1944 | Gerstung et al. . | |
| 3,695,641 | 10/1972 | Engelking et al. | 285/179.1 |
| 3,743,011 | 7/1973 | Frost | 165/38 |
| 3,831,671 | 8/1974 | Was | 165/154 |
| 4,094,358 | 6/1978 | Neveux | 165/916 |
| 4,360,055 | 11/1982 | Frost | 165/38 |
| 4,561,494 | 12/1985 | Frost | 165/76 |
| 4,580,625 | 4/1986 | Yamanaka et al. | 165/167 |
| 4,669,532 | 6/1987 | Tejima et al. | 165/36 |
| 4,831,980 | 5/1989 | Nasu et al. | 123/196 A |
| 4,967,835 | 11/1990 | Lefeber | 165/167 |
| 5,048,596 | 9/1991 | Lu | 165/916 |
| 5,067,561 | 11/1991 | Joshi et al. | 165/916 |
| 5,236,043 | 8/1993 | Armbruster et al. | 165/167 |
| 5,363,910 | 11/1994 | Baba et al. | 285/188 |
| 5,538,076 | 7/1996 | Nishida et al. | 165/178 |

FOREIGN PATENT DOCUMENTS

| | | | |
|---|---|---|---|
| 290340 | 11/1988 | European Pat. Off. | 165/916 |
| 2614687 | 11/1988 | France | 165/916 |

*Primary Examiner*—Eric K. Nicholson
*Attorney, Agent, or Firm*—Wood, Phillips, VanSanten, Clark & Mortimer

[57] ABSTRACT

An oil cooler (16) including an oil cooler housing (22) and a coolant hose connection (24) for transferring a coolant flow between a coolant hose (28) and the oil cooler housing (22), wherein the hose connection (24) changes the direction of the coolant flow through a predetermined angle after the coolant flow has entered the hose connection (24). The hose connection (24) includes a first opening (60) in the oil cooler housing (22) and a unitary piece of tubing (30) having first and second ends (32) and (34), a coolant opening (38) formed intermediate the ends (32) and (34) to transfer a coolant flow therethrough. The second end (34) is adapted for connection with the coolant hose (28) to transfer a coolant flow therewith. A flange (42) is formed around one of the coolant opening (38) and the first opening (60) and received in the other of the coolant opening (38) and the first opening (60).

12 Claims, 3 Drawing Sheets

2/3

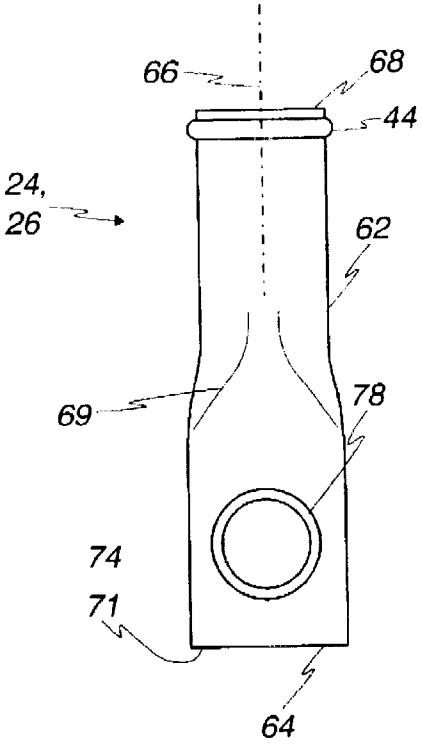
Fig. 7
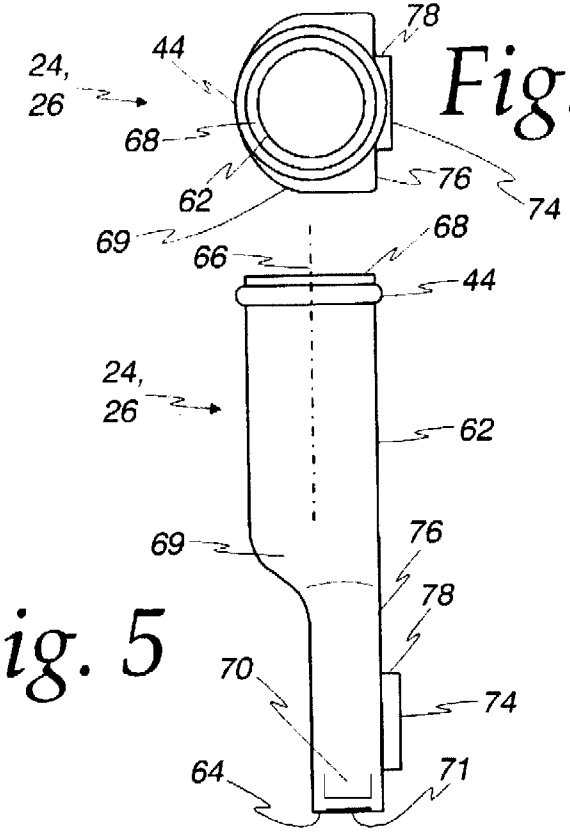
Fig. 5
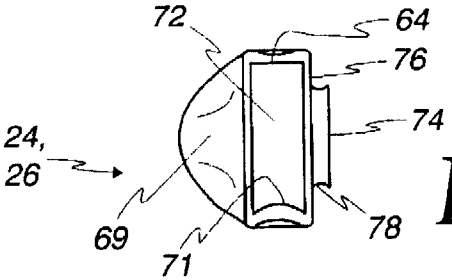
Fig. 8
Fig. 9
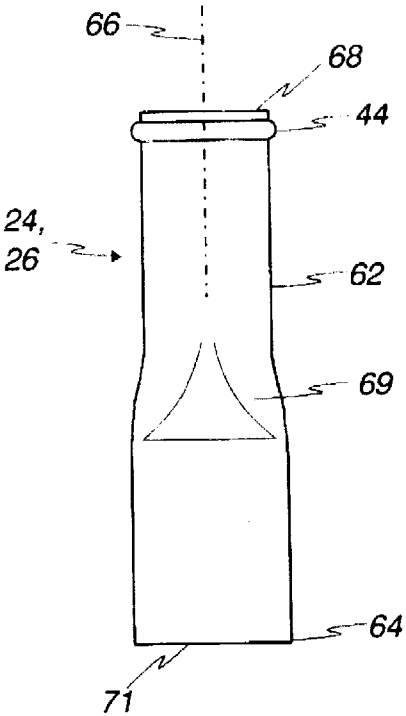
Fig. 6

OIL COOLER WITH IMPROVED COOLANT HOSE CONNECTION

FIELD OF THE INVENTION

This invention generally relates to the art of heat exchangers and, more particularly, to heat exchangers used as oil coolers in vehicular applications.

BACKGROUND OF THE INVENTION

The use of heat exchangers to cool lubricating oil employed in the lubrication systems of internal combustion engines has long been known. One form of such heat exchanger currently in use is a so-called "donut" oil cooler. Typically, these oil coolers have an axial length of only a couple of inches or less and are constructed so that they may be interposed between the engine block and the oil filter, being attached directly to the block in a location formerly occupied by the oil filter. Oil coolers of this type typically include a multi-piece housing which is connected to the vehicular cooling system to receive coolant, and which contains a stack of relatively thin, disk-like chambers through which the oil to be cooled is circulated. Examples of such oil coolers are disclosed in U.S. Pat. Nos. 4,967,835, issued Nov. 6, 1990 to Lefeber; 4,561,494, issued Dec. 31, 1985 to Frost; 4,360,055, issued Nov. 23, 1982 to Frost; and 3,743,011, issued Jul. 3, 1973 to Frost, the entire disclosures of which are herein incorporated by reference.

Commonly, the housings of such oil coolers are provided with a pair of hose connections, one for connection with an inlet coolant hose providing coolant flow from the vehicular coolant system and one connected to a coolant outlet hose for returning coolant flow to the vehicular coolant system. In one form, the hose connections are straight hose connections that do not impart any change in the coolant flow direction. Examples of such straight hose connections are shown in U.S. Pat. Nos. 4,967,835 and 4,561,494. In another form, the hose connections impart a change in the coolant flow direction, typically a 90° turn to the axis of the coolant flow direction. This form of hose connection is desirable when there is a limited amount of engine compartment space, as is typical, and the vehicle OEM prefers a 90° turn in the hose connection over molding a 90° turn in the coolant hose.

Hose connections utilizing a bent piece of tubing to impart a 90° change in the coolant flow direction are well known. Typically, to prevent pinching of the tube, cracking of the tube wall and/or thinning of the tube wall, the tube bend radius cannot be less than 1.5 times the tube diameter. This tube bend radius inherently offsets the coolant hose to hose connection interface at least 1.5 tube diameters from the oil cooler housing to hose connection interface. Accordingly, one disadvantage of this type of hose connection is the extra engine compartment volume required to accommodate the tube bend radius. Another disadvantage associated with the tube bend radius is the additional moment arm at the interface between the oil cooler housing and the hose connection which can result in relatively large stresses caused by the weight of the hose and coolant acting at the hose connection. When coupled with vibrations common in vehicle applications, these increased stresses can result in premature oil cooler housing wall fatigue failures around the interface between the oil cooler housing and the hose connection.

Hose connections utilizing a nipple tube brazed to a machined block to impart a 90° change in the coolant flow direction are also known. The machined block is connected to the oil cooler housing and imparts a 90° turn to the coolant flow from the nipple tube, which is adapted to connect with a coolant hose. One disadvantage associated with this type of hose connection is the manufacturing cost, which is expensive due to the machined block, the brazing of the nipple tube to the machined block, and the TIG welding of the machined block to the housing prior to brazing the machined block to the housing. Additionally, because the blocks cannot easily be staked to the cooler housing, the blocks are tack welded to the cooler housing to retain them in position until brazing. The heat-affected zones in the cooler housing resulting from the tack welds create stress risers and, in some cases, the oil cooler housing is completely perforated by the tack weld. Finally, the brazed interface between the machined block and the nipple tube introduces a potential failure point where the hose connection may fail structurally and/or leak.

Thus, it can be seen that there is need for a new hose connection that can be incorporated in an oil cooler to impart a change in the coolant flow direction between the oil cooler housing and the coolant hose while minimizing the amount of engine compartment volume required to accommodate the hose connection and/or the stresses around the interface between the hose connection and the housing, and/or the expense of manufacturing the hose connection and attaching it to the housing.

SUMMARY OF THE INVENTION

It is a principal object of the invention to provide a new and improved hose connection. More specifically, it is an object of the invention to provide a reliable hose connection that can be used in conjunction with an oil cooler, preferably a donut oil cooler, to impart a change in the coolant flow direction between the oil cooler and coolant hose while minimizing the amount of engine compartment volume required to accommodate the hose connection and/or minimizing the stress at the interface between the hose connection and the housing and/or minimizing the expense associated with manufacturing the hose connection and attaching it to the housing.

An exemplary embodiment of the invention achieves the foregoing objects in an oil cooler including an oil cooler housing and a coolant hose connection for transferring a coolant flow between a coolant hose and the oil cooler housing. The connection changes the direction of the coolant flow through a predetermined angle after the coolant flow has entered the connection. The connection includes a first opening in the oil cooler housing and a unitary piece of tube having a first end, a coolant opening formed adjacent the first end to transfer coolant flow therethrough, and a second end adapted for connection with a coolant hose to transfer a coolant flow therewith. The connection further includes a flange formed around one of the coolant opening and the first opening and received in the other of the coolant opening and the first opening.

According to one facet of the invention, a flat face is formed adjacent the first end and the coolant opening is formed through the flat face. The oil cooler housing includes a flat surface mating with the flat face of the piece of tubing.

According to another facet of the invention, the piece of tubing has a round section adapted for connection with a coolant hose to transfer coolant flow therewith, a quadrilateral section adapted for connection with the oil cooler housing, and a transition section joining the round section and the quadrilateral section. The coolant opening is formed in a side of the quadrilateral section.

According to the present invention, a method is provided for manufacturing an oil cooler having an oil cooler housing and a coolant hose connection for transferring a coolant flow between a coolant hose and the oil cooler housing, wherein the connection changes the direction of the coolant flow through a predetermined angle after the coolant flow has entered the connection. The method includes the steps of providing a unitary piece of tubing, providing an oil cooler housing, forming a first opening in the oil cooler housing, forming a coolant opening in a wall of the piece of tubing for transferring coolant therethrough, forming an end on the piece of tubing adapted for connection with a coolant hose for transferring coolant therewith, forming a flange around one of the first opening and the coolant opening, and inserting the flange into the other of the first opening and the coolant opening.

According to one facet of the invention, the method further includes the steps of forming a flat face on the piece of tubing through which the second opening will be formed, and forming a flat surface on the oil cooler housing through which the first opening will be formed.

According to another facet of the invention, the method further includes the step of providing copper cladding on at least one of the piece of tubing and the oil cooler housing to act as a brazing alloy, and brazing the piece of tubing to the oil cooler housing.

Other objects and advantages will become apparent from the following specification taken in conjunction with the accompanying drawings.

BRIEF DESCRIPTION OF THE DRAWINGS

FIG. 5 is a side elevation view of another embodiment of a hose connection embodying the present invention;

FIG. 6 is a rear view of the hose connection shown in FIG. 5;

FIG. 7 is a front view of the hose connection shown in FIG. 5;

FIG. 8 is a bottom view of the hose connection shown in FIG. 5; and

FIG. 9 is a top view of the hose connection shown in FIG. 5.

DETAILED DESCRIPTION OF THE PREFERRED EMBODIMENTS

Figure 1:
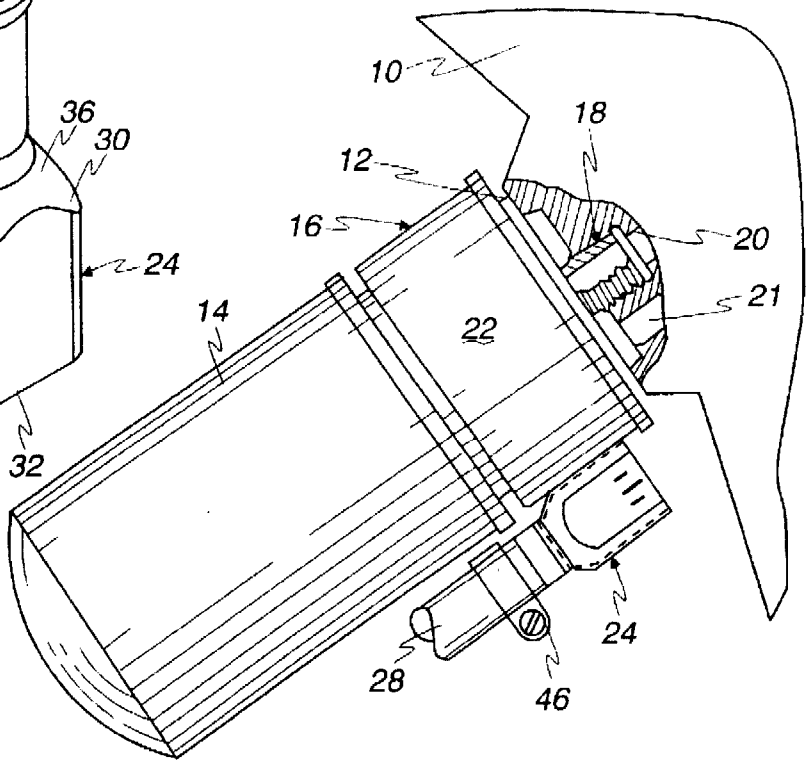
FIG. 1 is a side elevational view, partially in section, of an engine block having mounted thereon an oil cooler employing the coolant hose connection embodying the invention, with a filter of the customary type in position superimposed on the oil cooler.

An exemplary embodiment of a hose connection made according to the invention is described herein and is illustrated in the drawings in connection with an oil cooling function for the lubricating oil of a combustion engine. However, it should be understood that the invention may find utility in other applications, and that no limitation to use as an oil cooler is intended except insofar as expressly stated in the appended claims.

Figure 2:
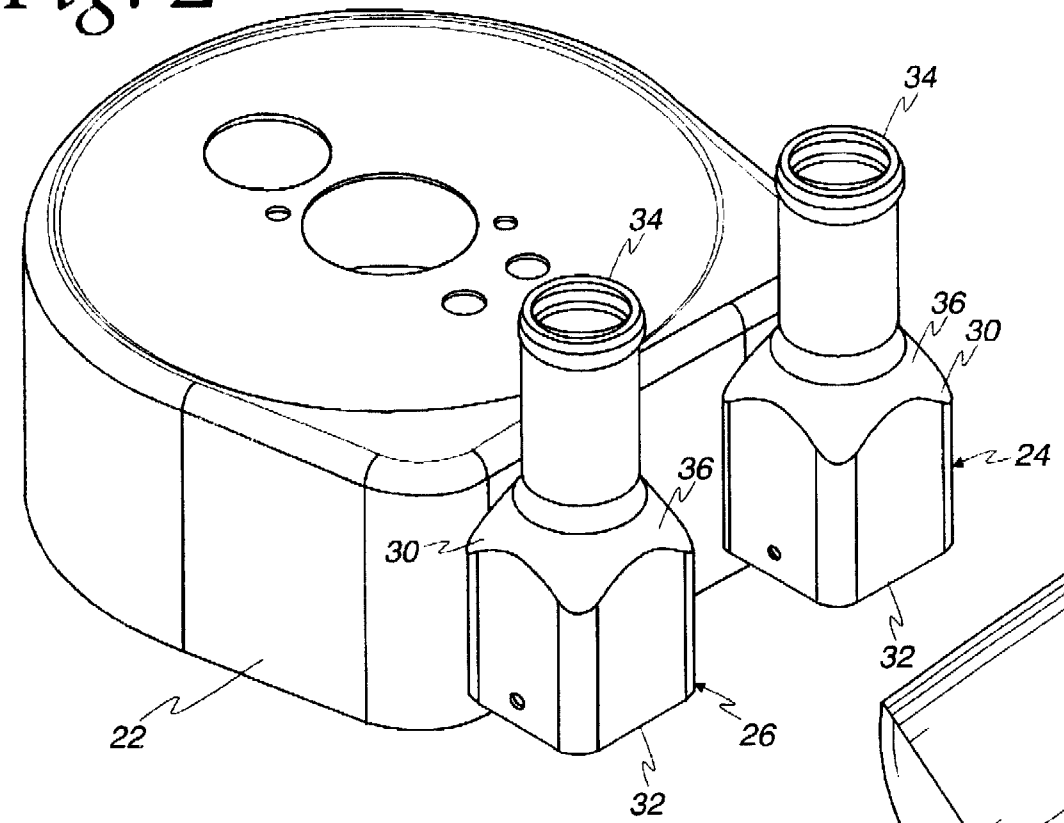
FIG. 2 is a perspective view of the oil cooler housing and hose connections shown in FIG. 1.

With reference to FIG. 1, the block of an internal combustion engine is fragmentarily shown at 10 and includes a seat 12 which is normally adapted to receive an oil filter 14. In the case of the invention, however, a donut oil cooler, generally designated 16, is interposed between the oil filter 14 and the seat 12. More particularly, the oil cooler 16 is held in sandwiched relation between the filter 14 and the seat 12 by an adapter/oil transfer tube 18 of suitable construction, as is known. The oil transfer tube 18 has one threaded end that is inserted in an oil return port 20 in the seat 12. An oil supply gallery or port 21 is also provided in the seat 12. A housing 22 of the oil cooler 16 includes spaced inlet and outlet hose connections 24 and 26 (best seen in FIG. 2), respectively, which may be connected by coolant hoses, such as coolant hose 28, into the coolant system for the internal combustion engine. The housing 22 includes a plurality of heat exchange units (not shown) that are disposed between the supply port 21 and the return port 20. The heat exchange units may be of any configuration commonly employed in the field of donut oil coolers, examples of which are described in detail in U.S. Pat. Nos. 3,743,011; 4,360,055; 4,561,494; and 4,967,835.

Each of the hose connections 24 and 26 includes a unitary piece of tubing 30 having a first end 32 and a second end 34. The first end 32 has a polygonal cross section in the form of a quadrilateral and the second end 34 has a round cross section adapted for connection with the coolant hose 28. A transition section 36 joins the round cross section of the second end 34 to the quadrilateral cross section of the first end 32.

Figure 3:
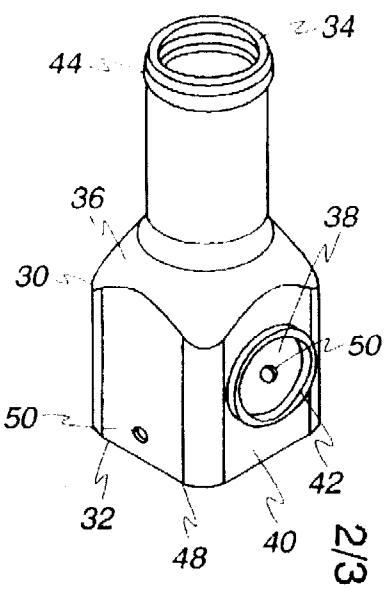
FIG. 3 is a perspective view of one of the hose connections shown in FIG. 2.

As best seen in FIG. 3, a coolant opening 38 is formed in a flat face 40 adjacent the first end 32 of the unitary piece of tubing 30, that is, intermediate the ends 32 and 34 but closer to the former than the latter. A flange 42 is formed around the coolant opening 38 and extends away from the face 40. The second end 34 includes a hose bead 44, as is well known to those skilled in the art. A coolant hose, such as coolant hose 28 shown in FIG. 1, may be placed over the hose bead 44 and clamped to the unitary piece of tubing 30 by a hose clamp 46, as shown in FIG. 1.

Figure 4:
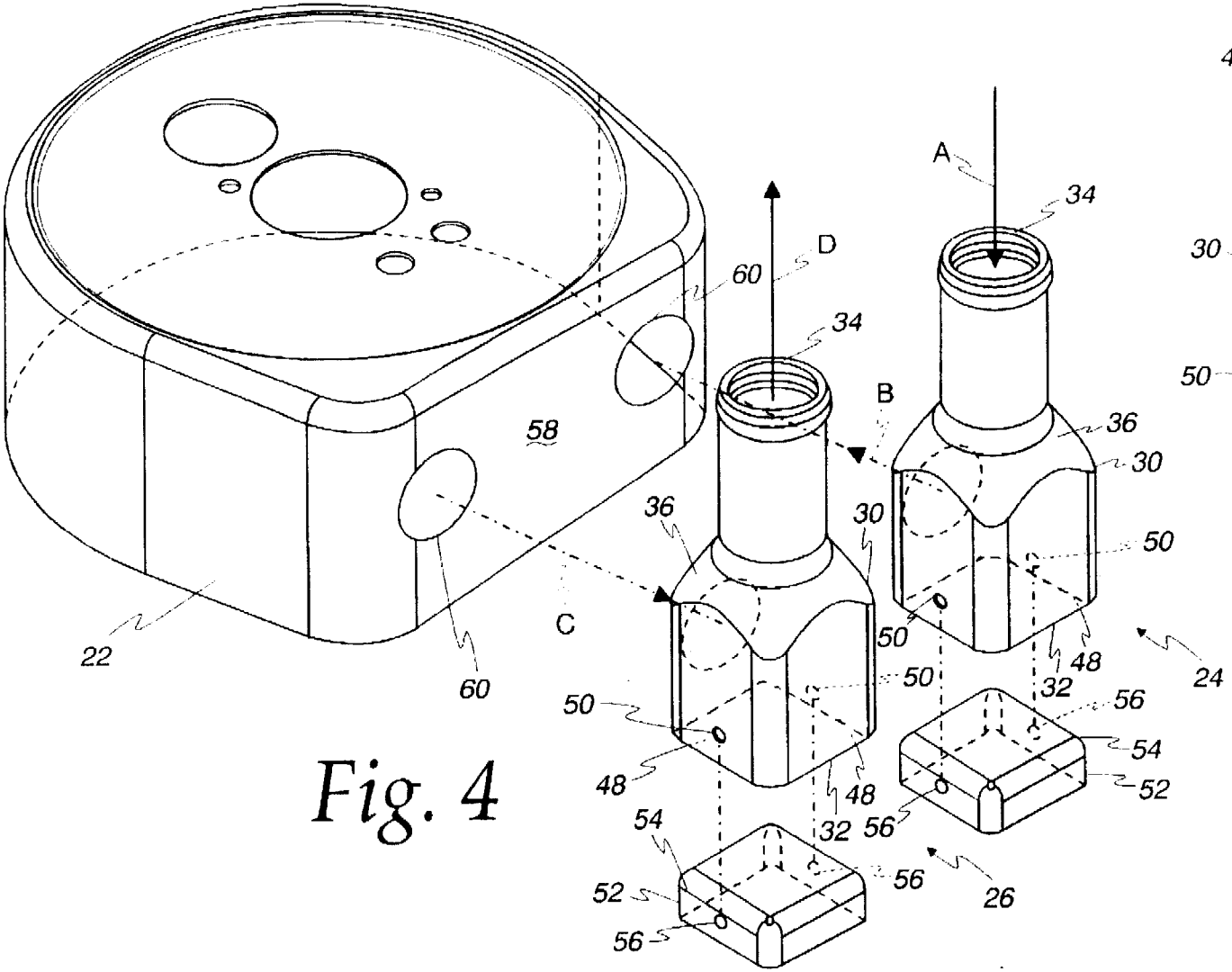
FIG. 4 is an exploded perspective view of the housing and hose connection shown in FIG. 2.

As best seen in FIG. 4, each unitary piece of tubing 30 includes an end opening 48 and two oppositely-spaced semispherical, inwardly directed tabs or "semi-knockouts" 50 adjacent the end opening 48 and extending into the tube 30. A plug 52 having a quadrilateral cross section is received in the end opening 48. Each plug 52 includes a lead in radius 54 to aid in insertion of the plug 52 into the end opening 48 and a pair of oppositely-spaced holes or dimples 56 that are adapted to receive the tabs 50 when the plug 52 is inserted into the end opening 48. The arrangement is akin to a so-called "snap fit" connection.

As best seen in FIG. 4, the housing 22 includes a flat surface 58 having a pair of openings 60. Each opening 60 is adapted to receive one of the flanges 42 of one of the unitary pieces of tubing 30.

Each unitary piece of tubing 30 preferably is formed from a length of round tubing. The quadrilateral cross section is either die-formed or swaged onto the first end 32. The coolant opening 38 and the flange 42 may be formed in the flat face 40 using any of the methods commonly employed by those skilled in the art. One preferred method is the "T-drill" method, as is known to those skilled in the art. In another preferred method, the coolant opening 38 may be pre-drilled and then the flange 42 formed by forcing an oversized metal ball through the coolant opening 38, as is also known to those skilled in the art. The hose bead 44 is formed on the second end 34 by any of the methods commonly employed by those skilled in the art.

The unitary piece of tubing 30 and the housing 22 are preferably copper clad steel, but may be made of other commonly-employed materials, such as aluminum or braze clad aluminum. To assemble the hose connections, 24 and 26, the flanges 42 on the unitary pieces of tubing 30 are inserted into the hole 60 in the housing 22, with the flat faces 40 of the unitary pieces of tubing 30 abutting the flat surface 58 of the housing 22. Each flange 42 is then staked or expanded to retain the flange 42 in the opening 60, with the flat face 40 abutting the flat surface 58. Next, a small amount of braze paste or a braze shim of copper is applied to the top of the plugs 52 prior to insertion and then the plugs 52 are inserted into the end openings 48 until the tabs 50 are received in the holes 56. The remainder of the oil cooler 16 is then assembled and the entire cooler assembly is subject to a furnace braze cycle, as is known, that brazes the flanges 42 into the opening 60 and the flat faces 40 to the flat surface 58, with the copper cladding of the piece of tubing 30 and the housing 22 acting as the brazing alloy.

When the oil cooler 16 has been installed on an engine block 10, coolant flow is transferred from an inlet coolant hose 28 to the inlet hose connection 24 through the open end of the second end 34 in the direction indicated by arrow A in FIG. 4. The coolant flow then passes from the second end 34 through the transition section 36 into the first end 32 where the coolant flow is turned by the hose connection 24 through approximately 90° and directed out of the coolant opening 38 and into the oil cooler housing 22 in the direction indicated by arrow B in FIG. 4. After circulating through the oil cooler 16, the coolant flow passes through the coolant opening 38 of the outlet hose connection 26 and into the first end 32 of the unitary piece of tubing 30 in the direction indicated by arrow C in FIG. 4. The coolant flow is then turned by the hose connection 26 through approximately 90° and then passes through the transition section 36 into the second end 34. Finally, the coolant flow is transferred through the open end of the second end 34 into an outlet coolant hose 28 in the direction indicated by arrow D in FIG. 4.

FIGS. 5, 6, 7, 8, and 9 illustrate a preferred embodiment of the hose connections 24 and 26. In this embodiment, a unitary piece of tubing 62 has a first end 64 with a polygonal cross section that is rectangular and offset from a central axis 66 of the piece of tubing 62, as defined by the round cross section of a second end 68. A transition section 69 joins the round cross section of the second end 68 to the rectangular cross section of the first end 64. This embodiment utilizes a pair of oppositely-spaced indented tabs 70 adjacent an end opening 71, rather than the semispherical tabs 50 employed in the embodiment shown in FIGS. 3 and 4. The tabs 70 prevent a plug 72 from being inserted too far into the end opening 71. The plug 72 has a similar construction to the plug 52 but has a rectangular cross section to match the rectangular cross section of the first end 64. After the plug 72 is inserted into the piece of tubing 62, the tubing is crimped adjacent the end opening 71 to retain the plug 72.

As best seen in FIG. 7, a coolant opening 74 is formed in a flat face 76 adjacent the first end 64 of the unitary piece of tubing 62, that is, intermediate the ends 64 and 68, but closer to the former than the latter. A flange 78 is formed around the coolant opening 74 and extends away from the face 76. The second end 68 includes a hose bead 44 that is well known to those skilled in the art. A coolant hose, such as coolant hose 28, shown in FIG. 1, may be placed over the hose bead 44 and clamped to the unitary piece of tubing 62 by a hose clamp 46, as shown in FIG. 1.

As with the embodiment shown in FIGS. 3 and 4, each unitary piece of tubing 62 preferably is formed from a length of round tubing. The rectangular cross section is swaged onto the first end 64. The coolant opening 74 and the flange 78 are formed in the flat face 76 using any of the methods commonly employed by those skilled in the art, including the two preferred methods previously discussed in connection with the coolant opening 38 and the flange 42 of the embodiments shown in FIGS. 3 and 4. The hose bead 44 is formed on the second end 68 by any of the methods commonly employed by those skilled in the art.

The assembly and operation of the embodiment of the hose connection 24,26 shown in FIGS. 5, 6, 7, 8 and 9, is exactly the same as has been previously described with respect to the embodiments of the hose connections 24 and 26 shown in FIGS. 1, 2, 3 and 4.

It will be appreciated that the hose connections 24 and 26 are particularly well adapted for transferring a coolant flow between a coolant hose and an oil cooler housing through a predetermined angle. Compared to conventional machined block/nipple tube type hose connection, the hose connections 24 and 26 are simpler and less expensive to manufacture and assemble into an oil cooler. Compared to bent hose connections, the hose connections 24 and 26 require less engine compartment volume while reducing the stresses and fatigue failures around the interface between the hose connection and the oil cooler housing.

I claim:

1. In an oil cooler including an oil cooler housing and a coolant hose connection for transferring a coolant flow between a coolant hose and the oil cooler housing, the connection changing the direction of the coolant flow through a predetermined angle after the coolant flow has entered the connection, the improvement wherein said connection comprises:

a first opening in the oil cooler housing, a unitary piece of tubing having first and second ends, a coolant opening formed intermediate said ends to transfer a coolant flow therethrough, and said second end adapted for connection with a coolant hose to transfer a coolant flow therewith; and a flange formed around one of the coolant opening and the first opening and received in the other of the coolant opening and the first opening.

2. The improvement of claim 1 wherein the piece of tubing further comprises a flat face formed adjacent the first end and at least a portion of the piece of tubing has a generally round cross section.

3. The improvement of claim 1 further comprising a plug and wherein the piece of tubing further comprises an end opening in the first end, the end opening receiving the plug.

4. In an oil cooler including an oil cooler housing and a coolant hose connection for transferring a coolant flow between a coolant hose and the oil cooler housing, the connection changing the direction of the coolant flow through a predetermined angle after the coolant flow has entered the connection, the improvement wherein said connection comprises:

a unitary piece of tubing having a first end, a flat face formed adjacent the first end, a coolant opening formed through the flat face to transfer a coolant flow therethrough, and a second end having a generally round cross section and being adapted for connection with a coolant hose to transfer a coolant flow therewith;

a first opening in the oil cooler housing in fluid communication with the coolant opening.

5. The improvement of claim 4 wherein one of the coolant opening and the first opening is a flanged opening and the other of the coolant opening and the first opening is a flange receiving opening.

6. The improvement of claim 4 wherein the oil cooler housing further comprises a flat surface mating with the flat face of the piece of tubing.

7. In an oil cooler including an oil cooler housing and a coolant hose connection for transferring a coolant flow between a coolant hose and the oil cooler housing, the connection changing the direction of the coolant flow through a predetermined angle after the coolant flow has entered the connection, the improvement wherein said connection comprises:

a unitary piece of tubing having a round section adapted for connection with a coolant hose to transfer a coolant flow therewith, a polygonal section adapted for connection with the oil cooler housing, a transition section joining the round section and the polygonal section, and a coolant opening formed in a side of the polygonal section to transfer a coolant flow therethrough;

a first opening in the oil cooler housing in fluid communication with the coolant opening; and wherein one of the coolant opening and the first opening is a flanged opening and the other of the coolant opening and the first opening is a flange receiving opening.

8. A method of manufacturing an oil cooler having an oil cooler housing and a coolant hose connection for transferring a coolant flow between a coolant hose and the oil cooler housing, the connection changing the direction of the coolant flow through a predetermined angle after the coolant flow has entered the connection, the method comprising the steps of:

providing a unitary piece of tubing having a pair of ends, one of said ends adapted for connection with a coolant hose for transferring coolant therewith;

providing an oil cooler housing;

forming a first opening in the oil cooler housing;

forming a coolant opening in a wall of the piece of tubing for transferring coolant therethrough;

forming a flange around one of the first opening and the coolant opening; and inserting the flange into the other of the first opening and the coolant opening.

9. The method of claim 8 further comprising the steps of:

forming a flat face on the piece of tubing through which the second opening will be formed; and forming a flat surface on the oil cooler housing through which the first opening will be formed.

10. The method of claim 9 further comprising the step of brazing the piece of tubing to the oil cooler housing.

11. The method of claim 9 further comprising the step of providing copper cladding on at least one of the piece of tubing and the oil cooler housing to act as the brazing alloy.

12. The method of claim 9 wherein the piece of tubing is substantially round when initially provided.

* * * * *